US006758409B1

(12) United States Patent
Itoh

(10) Patent No.: US 6,758,409 B1
(45) Date of Patent: Jul. 6, 2004

(54) FUEL INJECTION NOZZLE

(75) Inventor: Katsuoki Itoh, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 269 days.

(21) Appl. No.: 09/869,907

(22) PCT Filed: Oct. 20, 2000

(86) PCT No.: PCT/DE00/03694

§ 371 (c)(1),
(2), (4) Date: Dec. 17, 2001

(87) PCT Pub. No.: WO01/34967

PCT Pub. Date: May 17, 2001

(30) Foreign Application Priority Data

Nov. 8, 1999 (DE) ..... 199 53 562

(51) Int. Cl.[7] ..... B05B 1/08; B05B 1/30; F02M 39/00

(52) U.S. Cl. ..... 239/102.2; 239/533.2; 239/533.3; 239/585.4; 239/585.5

(58) Field of Search ..... 239/88, 91, 89, 239/93, 94, 533.2, 533.3, 585.1, 585.3, 585.4, 585.5, 102.2; 251/129.15, 129.21, 127

(56) References Cited

U.S. PATENT DOCUMENTS 4,463,901 A * 8/1984 Perr et al. ..... 239/95
4,721,247 A * 1/1988 Perr ..... 239/91
5,094,397 A * 3/1992 Peters et al. ..... 239/88
5,280,773 A * 1/1994 Henkel
5,295,470 A * 3/1994 Straubel ..... 123/458
5,810,255 A * 9/1998 Itoh et al. ..... 239/102.2
6,247,453 B1 * 6/2001 Potschin et al. ..... 123/472
6,302,333 B1 * 10/2001 Hoffmann et al. ..... 239/88
6,390,384 B1 * 5/2002 Sato et al. ..... 239/91

FOREIGN PATENT DOCUMENTS

DE 19 10 143 A 11/1970
DE 35 33 085 A 3/1987
DE 195 34 445 A 3/1997
DE 198 44 837 A 4/2000

* cited by examiner

*Primary Examiner*—D. Hwu
(74) *Attorney, Agent, or Firm*—Ronald E. Greigg

(57) ABSTRACT

In a fuel injection nozzle having a nozzle body, a nozzle needle that is displaceable in the nozzle body, a piezoelectric actuator that is connected to the nozzle needle, and a compensation piston on which the piezoelectric actuator is braced and which protrudes into a compensation chamber that is filled with a fluid, where the compensation chamber communicates with a supply volume through an inlet of small cross section, a simpler design is to be attained. To that end, it is provided that the supply volume is subjected to variable pressure making it possible to dispense with a separate restoring spring for the nozzle needle.

16 Claims, 1 Drawing Sheet

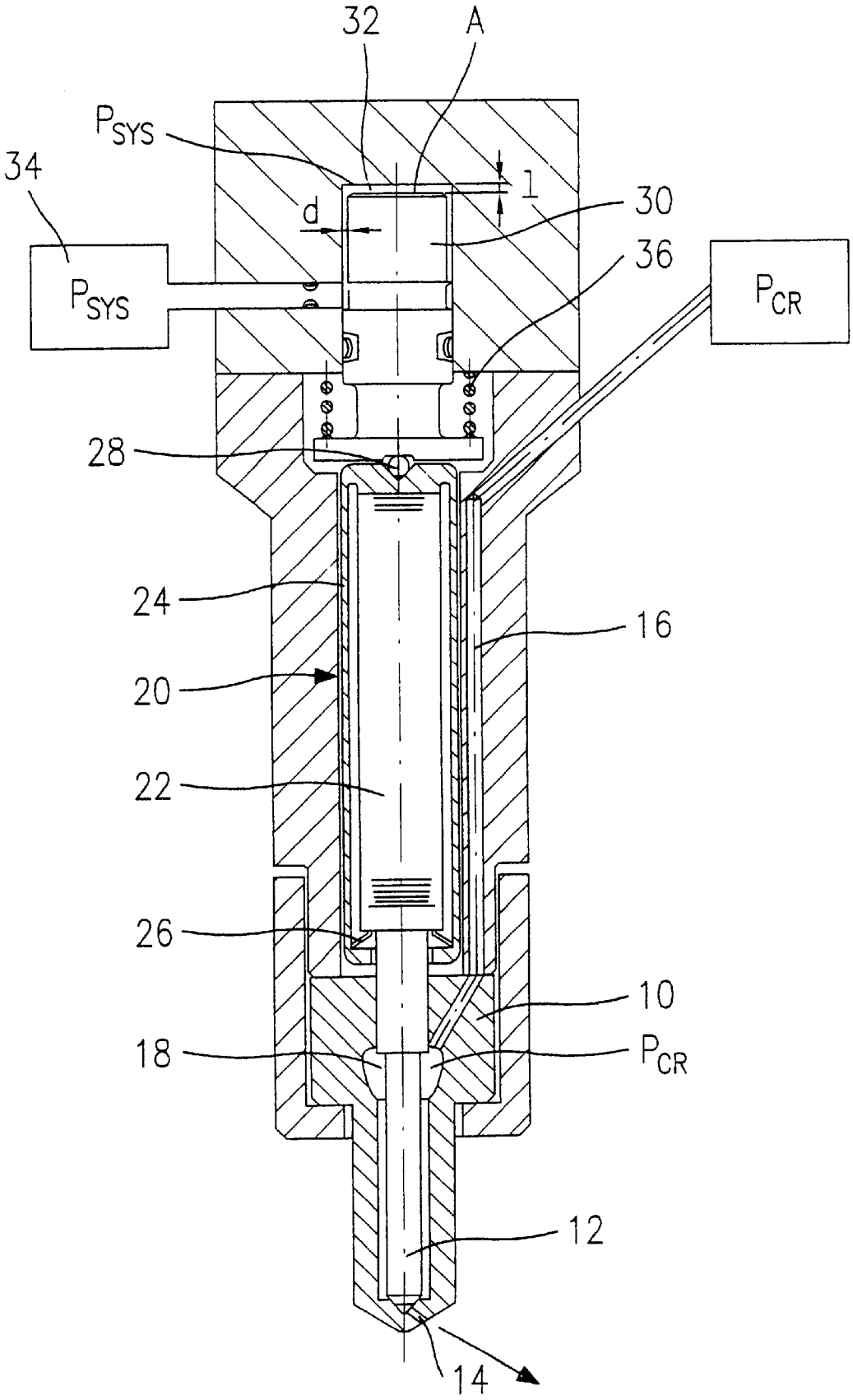
32
A
$P_{SYS}$
34
1
d
30
36
$P_{SYS}$
$P_{CR}$
28
24
16
20
22
26
10
18
$P_{CR}$
12
14

FUEL INJECTION NOZZLE

CROSS-REFERENCE TO RELATED APPLICATIONS

This application is a 35 USC 371 application of PCT/DE 00/03694 filed on Oct. 20, 2000.

BACKGROUND OF THE INVENTION

1. Field of the Invention

The invention relates to a fuel injection nozzle having a nozzle body, a nozzle needle that is displaceable in the nozzle body, a piezoelectric actuator that is connected to the nozzle needle, and a compensation piston on which the piezoelectric actuator is braced and which protrudes into a compensation chamber that is filled with a fluid, wherein the compensation chamber communicates with a supply volume through an inlet of small cross section.

2. Description of the Prior Art

One such injection nozzle is known from German Patent Disclosure DE 35 33 085 A1. The compensation piston makes it possible to compensate for a change in length of the piezoelectric actuator that ensues at low speed. A change in length of this kind is brought about in particular by a change in temperature. If such a change occurs, the fluid is positively displaced by the compensation piston either out of or into the compensation chamber. Conversely, if a rapid change in length of the piezoelectric actuator occurs, as is brought about for opening of the nozzle needle, then because of the small cross section of the inlet, such high resistance to any displacement of the fluid present in the compensation chamber is presented that the compensation piston functions as a rigid abutment. The nozzle needle can then be actuated without the compensation piston having any effect on the resultant opening stroke.

In the known injection nozzle, which is an outward-opening nozzle, a separate restoring spring is provided for the nozzle needle. Opening the nozzle needle requires that the piezoelectric actuator overcome the force exerted by the restoring spring, and this means strong actuation forces.

The object of the invention is to create a fuel injection nozzle that makes do without the restoring spring that has to be overcome by the piezoelectric actuator.

SUMMARY OF THE INVENTION

A fuel injection nozzle of the type defined at the outset has the advantage that the pressure prevailing in the supply volume, which also acts on the compensation piston, is comparable to a restoring spring for the nozzle needle, so that a separate, strongly prestressed restoring spring can be dispensed with.

BRIEF DESCRIPTION OF THE DRAWING

The invention is described below with reference to the single drawing FIGURE which is a schematic section of a fuel injection nozzle embodying the invention.

DESCRIPTION OF THE PREFERRED EMBODIMENT

The injection nozzle has a nozzle body 10, in which an inward-opening nozzle needle 12 is displaceably disposed. The nozzle needle 12 can open injection ports 14, which are embodied in the nozzle body 10, in order to enable the injection of fuel, which is furnished via a delivery bore 16 and an annular conduit 18. The delivery bore 16 is supplied from a high-pressure collection line known as a "common rail".

On its end remote from the injection ports 14, the nozzle needle 12 is connected to a piezoelectric actuator 20, which comprises a stack of piezoelectric elements 22 and a holder 24. The piezoelectric elements are prestressed in the holder 24 by an annular spring 26. The piezoelectric actuator 20 is also provided with supply terminals, by means of which a voltage can be applied to the piezoelectric elements 22.

On the end of the piezoelectric actuator 20 remote from the injection ports 14, there is a ball 28, on which a compensation piston 30 rests. The ball 28 assures that any tolerances and deviations in position between the compensation piston 30 and the piezoelectric actuator 20 in the radial direction will not be transmitted from one part to the other. The piston 30 protrudes into a compensation chamber 32, which communicates with a supply volume 34 via an annular gap of thickness d between the wall of the compensation chamber 32 and the compensation piston 30. The supply volume is at the system pressure $P_{SYS}$, which is typically equal to the pressure of the furnished fuel.

Between the nozzle body 10 and a collar of the compensation piston 30, there is a compression spring 36, which urges the compensation piston 30 toward the piezoelectric actuator 20. The compression spring 36 thus acts upon the compensation piston 30 in the direction of increasing the volume of the compensation chamber 32.

The fuel injection nozzle described functions as follows: When the injection system associated with the injection nozzle is turned off, the compression spring 36 assures that the nozzle needle 12, via the piezoelectric actuator 20, is pressed into contact with the nozzle body 10, so that the injection ports 14 are closed, and no fuel from the injection nozzle can enter the combustion chamber of an internal combustion engine to be supplied. Conversely, if the injection system is turned on, and fuel which is under system pressure is furnished via the delivery bore 16, an opening pressure is generated at the annular shoulder of the nozzle needle 12, which shoulder is disposed in the annular chamber 18. This opening force urges the nozzle needle 12 upward, in terms of the drawing. The piezoelectric actuator 20 and the compensation piston 30 act counter to the opening force. In the equalization state, a voltage is applied to the piezoelectric elements 22, so that the individual piezoelectric elements lengthen axially. In this state, the rear end of the piezoelectric actuator 20 is braced, via the compensation piston 30, against the fluid that is located at system pressure in the compensation chamber 32. When the nozzle needle 12 is to be opened, the voltage applied to the piezoelectric elements 22 is interrupted. The piezoelectric elements thereupon contract axially, so that the nozzle needle 12 can execute an opening stroke of up to 0.25 mm. During this motion, the compensation piston 30 remains in its position, since the fluid present in the compensation chamber 32 does not allow any motion of the compensation piston 30; the annular gap around the compensation piston 30, through which the fluid could flow in from the supply volume 34 for replenishing purposes, is so small that the system, for the brief periods of time while the nozzle needle is open, can be assumed to be stationary. When the nozzle needle is to be closed again, the voltage is again applied to the piezoelectric elements 22, causing them to expand axially and displace the nozzle needle 12 into its closed position.

If conversely during the operation of the injection nozzle, a change in length of the components of the injection nozzle and in particular of the piezoelectric actuator occurs during a temperature change, this causes a corresponding displacement of the compensation piston 30 in the compensation chamber 32; the fluid is then either positively displaced out of the compensation chamber 32 or aspirated into it through the annular gap having the thickness d.

The foregoing relates to preferred exemplary embodiment of the invention, it being understood that other variants and embodiments thereof are possible within the spirit and scope of the invention, the latter being defined by the appended claims.

What is claimed is:

1. A fuel injection nozzle comprising a nozzle body (10), a nozzle needle (12) that is displaceable in the nozzle body, a piezoelectric actuator (20) that is connected to the nozzle needle, and a compensation piston (30) on which the piezoelectric actuator is braced and which protrudes into a compensation chamber (32) that is filled with a fluid, and means connecting said compensation chamber for fluid communication with a supply volume (34) through an inlet of small cross section and enabling a positive displacement of fluid out of or an aspiration of fluid into said compensation chamber (32) through said inlet to compensate for a change in length of the piezoelectric actuator (20) during a temperature change, said supply volume (34) being subjected to variable pressure.

2. The injection nozzle of claim 1, wherein said supply volume (34) is at the pressure of the fuel to be injected.

3. The injection nozzle of claim 2, wherein said supply volume (34) is filled with fuel.

4. The injection nozzle of claim 3, further comprising a spring (36) which engages said piezoelectric actuator (20) and urges said nozzle needle (12) into its closed position.

5. The injection nozzle of claim 4, further comprising a ball (28) disposed between the compensation piston and the piezoelectric actuator to enable an equalization of tolerances between said compensation piston and said piezoelectric actuator.

6. The injection nozzle of claim 3, further comprising a ball (28) disposed between the compensation piston and the piezoelectric actuator to enable an equalization of tolerances between said compensation piston and said piezoelectric actuator.

7. The injection nozzle of claim 2, further comprising a spring (36) which engages said piezoelectric actuator (20) and urges said nozzle needle (12) into its closed position.

8. The injection nozzle of claim 7 further comprising a ball (28) disposed between the compensation piston and the piezoelectric actuator to enable an equalization of tolerances between said compensation piston and said piezoelectric actuator.

9. The injection nozzle of claim 2, further comprising a ball (28) disposed between the compensation piston and the piezoelectric actuator to enable an equalization of tolerances between said compensation piston and said piezoelectric actuator.

10. The injection nozzle of claim 1, wherein said supply volume (34) is filled with fuel.

11. The injection nozzle of claim 10, further comprising a spring (36) which engages said piezoelectric actuator (20) and urges said nozzle needle (12) into its closed position.

12. The injection nozzle of claim 11, further comprising a ball (28) disposed between the compensation piston and the piezoelectric actuator to enable an equalization of tolerances between said compensation piston and said piezoelectric actuator.

13. The injection nozzle of claim 10, further comprising a ball (28) disposed between the compensation piston and the piezoelectric actuator to enable an equalization of tolerances between said compensation piston and said piezoelectric actuator.

14. The injection nozzle of claim 1, further comprising a spring (36) which engages said piezoelectric actuator (20) and urges said nozzle needle (12) into its closed position.

15. The injection nozzle of claim 14, further comprising a ball (28) disposed between the compensation piston and the piezoelectric actuator to enable an equalization of tolerances between said compensation piston and said piezoelectric 3 actuator.

16. The injection nozzle of claim 1, further comprising a ball (28) disposed between the compensation piston and the piezoelectric actuator to enable an equalization of tolerances between said compensation piston and said piezoelectric actuator.

* * * * *